United States Patent [19]

Yoshida

[11] 4,354,171

[45] Oct. 12, 1982

[54] ELEVATOR POSITION DETECTOR DEVICE

[75] Inventor: Masayuki Yoshida, Inazawa, Japan

[73] Assignee: Mitsubishi Denki Kabushiki Kaisha, Tokyo, Japan

[21] Appl. No.: 202,506

[22] Filed: Oct. 31, 1980

[30] Foreign Application Priority Data

Nov. 5, 1979 [JP] Japan ..... 54-143135

[51] Int. Cl.[3] ..... B66B 3/02

[52] U.S. Cl. ..... 340/21; 187/29 R

[58] Field of Search ..... 340/19 R, 21

[56] References Cited

U.S. PATENT DOCUMENTS 2,875,853 3/1959 Borden et al. ..... 340/21 X 3,889,231 6/1975 Tosato et al. ..... 340/21

4,149,614 4/1979 Mandel et al. ..... 340/19 R

*Primary Examiner*—David L. Trafton

*Attorney, Agent, or Firm*—Sughrue, Mion, Zinn, Macpeak & Seas

[57] ABSTRACT

A device for detecting the actual position of an elevator car using a computer has an interfloor detector 5 which detects the elevator car passing through an intermediate zone between adjacent landing floors, and a floor level detector 6 which detects when the elevator car is located at a landing floor. A position detecting device which is fed output signals from the two detectors precisely memorizes the actual position of the elevator car.

3 Claims, 3 Drawing Figures

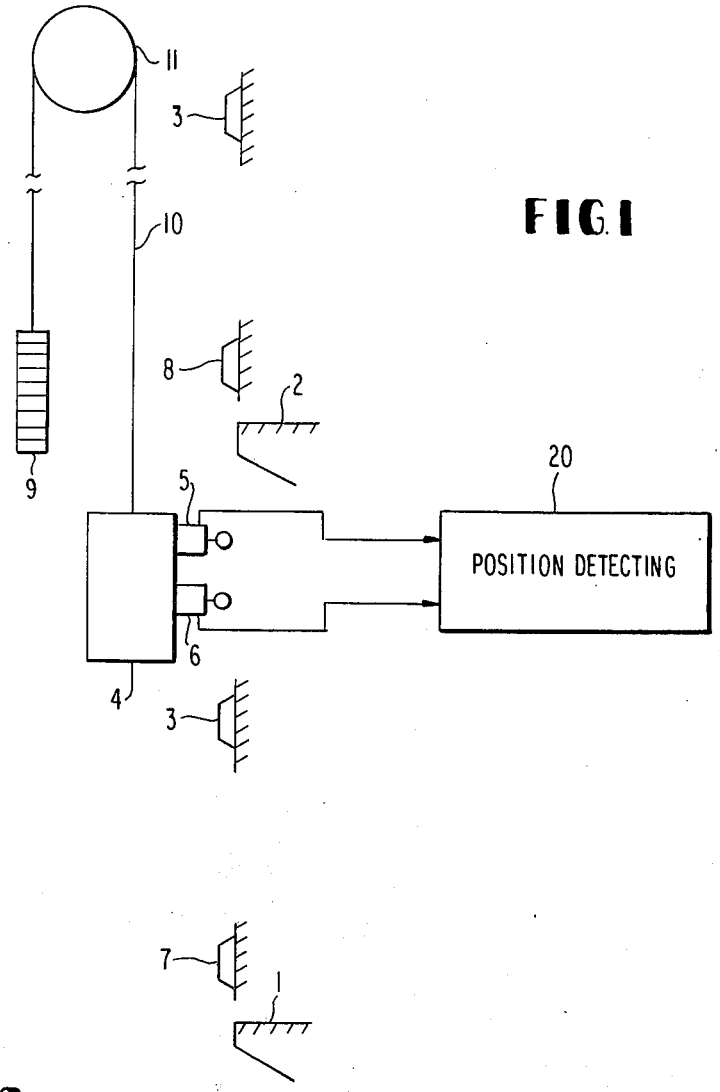
FIG. 1
FIG. 2
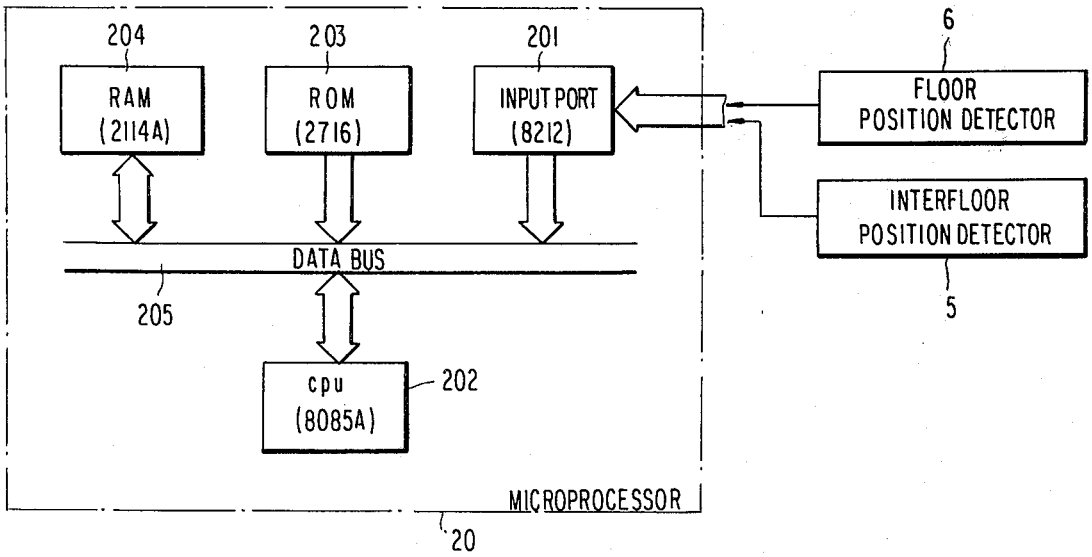

ELEVATOR POSITION DETECTOR DEVICE

BACKGROUND OF THE INVENTION

1. Field of the Invention

This invention relates to a device for detecting the position of an elevator car.

2. Description of the Prior Art

In an elevator control system, it is essential to detect the position of the elevator car, and for this purpose floor selectors are normally utilized.

There are a variety of types of floor selectors, but only recently computer and microprocessor devices have been adapted to perform the necessary computations formerly effected by means of mechanical selectors.

One known method is carried out by the provision of outwardly projecting switch actuating cams disposed at predetermined positions between adjacent floors within a hoistway or elevator shaft. An interfloor detector is installed on the elevator car and is adapted to operate when it engages one of the cams. A floor level detector is likewise installed on the elevator car and is similarly adapted to operate when it engages one of the cams. A position-detecting circuit computes and stores a car position signal from the information received from the interfloor and floor level detectors each time the detectors operate in response to the movement of the elevator car.

However, should the contacts of the detectors shake for any reason, or should the elevator car be moved slightly in the vicinity of the cams by manual control, the aforementioned computation is repeated each time contact is made by the detectors, and as a result the calculated position of the elevator car will be different from the actual car position.

SUMMARY OF THE INVENTION

Accordingly, it is an object of the present invention to eliminate the above-described drawback in the prior art.

More specifically, an object of this invention is to provide a new and improved elevator position detector device in which the calculated position of the elevator car always agrees precisely with the actual position of the car even though the elevator car might move irregularly or the interfloor detector might operate erroneously.

This invention accomplishes these objectives by the provision of a first detector for detecting the passing of the elevator car through a predetermined intermediate zone between adjacent landing floors, and a second detector for detecting that the elevator car is located at the landing floor. A position detecting means including a computer generates a car position signal from the output signals of the first and second detectors, and renews this car position signal only when the first and second detectors are operated in succession.

BRIEF DESCRIPTION OF THE DRAWINGS

In the drawings

FIG. 1 shows a block diagram of an elevator position detector device according to the present invention;

FIG. 2 is a block diagram showing one example of the position detecting means which comprises a microprocessor.

DETAILED DESCRIPTION OF THE PREFERRED EMBODIMENT

Figure 3:
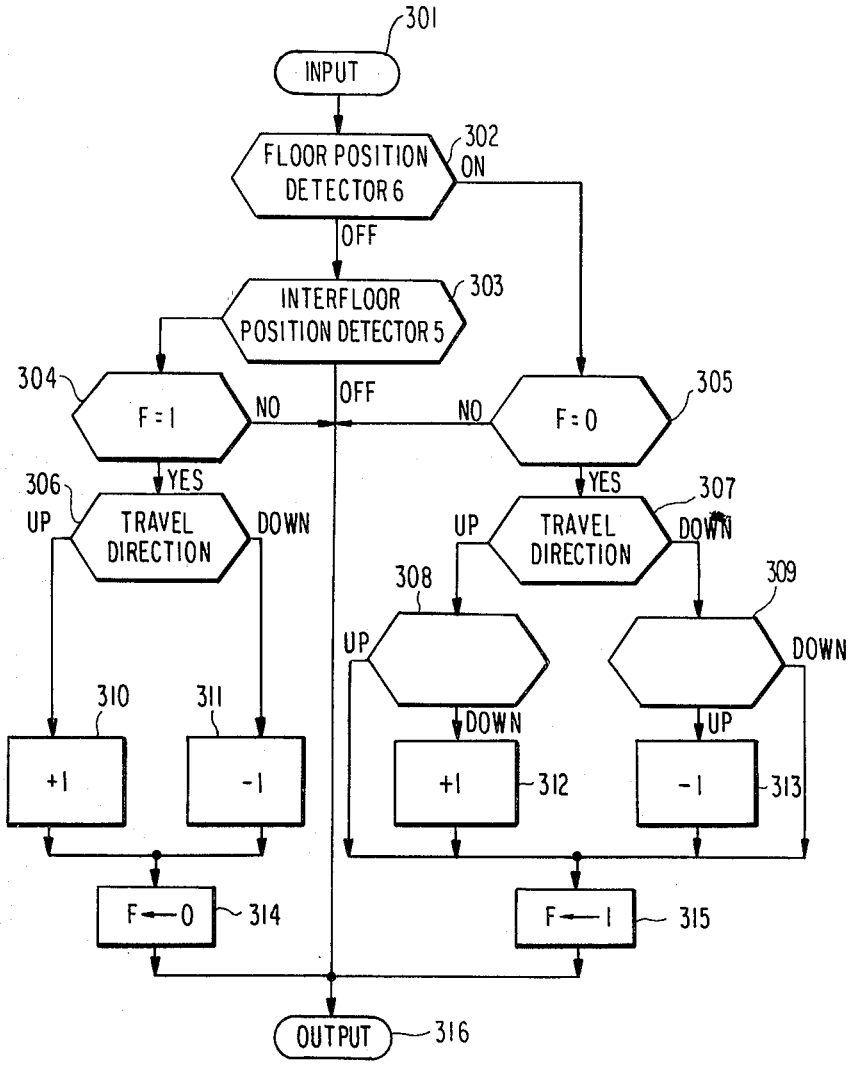
FIG. 3 is a flow diagram showing a floor calculation program employed in the position detecting means shown in FIG. 2.

Referring now to FIG. 1 of the drawings, the illustrated arrangement comprises a plurality of landing floors vertically disposed at predetermined intervals and served by an elevator car 4 which ascends and decends in a hoistway (not shown) extending vertically between the floors. The lowest floor is designated by reference numeral 1, and the floor located just above it is designated by reference numeral 2.

An actuating cam 3 is disposed at a predetermined position between floors 1 and 2 within the hoistway. Such cams are also disposed at other interfloor-positions, such as seen in the top portion of FIG. 1.

An interfloor detector 5 is installed on the elevator car 4 in order to detect when the car 4 is located at a predetermined position between the two floors.

Floor level detector 6 is installed on the elevator car 4 at a position laterally displaced fromthe interfloor detector 5 and detects when the elevator car 4 is located at a respective landing floor, 1 or 2. That is, cams 7 and 8 will engage the floor level detector 6 when the car 4 is respectively located at landing floor 1 or 2.

The floor level detector 6 and the cams 7 and 8 may also serve additional purposes, such as detecting the zone in which the doors of the car 4 may be opened, which is essential to the control of the elevator.

A counterweight 9 is connected to the car through a main cable 10 wound on a traction sheave 11. Position detecting means 20 receives output signals from the detectors 5 and 6.

FIG. 2 is a block diagram showing the position detecting means 20 which may, for example, be an Intel-8085 micro-processor. This micro-processor may, of course, be replaced by any other suitable digital computer. The microprocessor 20 comprises an input/port 201, such as an Intel-8212, a central processing unit 202, such as an Intel-8085A, a read only memory (ROM) 203, such as an Intel-2716, a random access memory (RAM) 204, such as an Intel-2114A, and a data bus 205.

The operation of the position detecting means 20 will now be described in conjunction with the upward travel of the elevator car 4. Assuming that the car is started upward from the lowermost landing floor 1, firstly, floor level detector 6 disengages the cam 7 and soon thereafter interfloor detector 5 engages the cam 3.

This engagement of interfloor detector 5 causes the output signal therefrom to flow to micro-processor 20 through input port 201. The signal is subsequently transferred to CPU 202, ROM 203 and RAM 204 through data bus 205. A signal indicating the direction of movement of the elevator car is also fed to the microprocessor from a separate source, well known in the art and not shown.

As a result, CPU 202 initially calculates the present car position according to the predetermined program memorized in ROM 203. That is, by adding a value corresponding to one floor to that of the car position signal memorized in RAM 204, this value is updated from FLOOR 1 to FLOOR 2 in response to the upward movement of the car.

Once updated, as will be hereinafter explained, even if interfloor detector 5 is subsequently repeatedly operated, no RAM memory update will take place unless floor level detector 6 is operated first.

Consequently, in this case, the shaking of the contact of interfloor detector 5 for any reason, or slight movement of the elevator car 4 by manual control will not cause the signal or floor value memorized in RAM 204 to be updated, causing the memorized value to remain, correctly, at FLOOR 2.

Subsequently, when the car 4 reaches the second floor 2, the floor level detector 6 engages cam 8, after which, much the same operation as aforementioned will be repeated. Furthermore, assuming that the direction of movement of elevator car 4 is reversed before the floor level detector 6 engages cam 8, elevator car 4 will begin to descend causing the interfloor detector 5 to engage cam 3 again.

The car position signal memorized in RAM 204 will not be updated, however, because the floor level detector 6 has not yet been operated.

When elevator car 4 subsequently reaches landing floor 1, floor level detector 6 engages cam 7 again to input a signal to the micro-processor 20. The microprocessor is suitably adapted to be able to detect the direction of car travel. As a result, the car position signal memorized in RAM 204 is changed from FLOOR 2 to FLOOR 1.

All of these memory updates are preformed by computation in accordance with the floor calculating flow diagram shown in FIG. 3, as described below.

In FIG. 3, which is a flow diagram illustrating the programmed of operation of CPU 202, a input 301 flows via decision chain 302 to 309 to an output 316, after enacting any of the processes denoted by boxes 310 to 315. Detectors 302 and 303 are adapted to discriminate between the operative states of the floor level detector 6 and interfloor detector 5, respectively.

Detector decision steps 306 and 307 are adapted to discriminate the actual direction of car travel and detector decision steps 308 and 309 are adapted to discriminate or "remember" the direction of car travel at the time when interfloor detector 5 was previously operated and process 310 or 311 was performed.

Processes 310 to 313 are adapted to add or subtract a signal corresponding to one floor to or from the memorized car position signal, as appropriate.

The character F shown in boxes 304, 305, 314 and 315 represents tentative data memorized in RAM 204 which are adapted to interlock so as to allow detectors 6 and 5 to operate only in succession, as more fully described below. In normal car operation, the processes 312 and 313 are not performed, and only one of processes 310 and 311 is performed.

In normal operation, the elevator car 4 will leave from the first or bottom floor 1, the RAM 204 having been previously set to contain the signals corresponding to "F"=1 and FLOOR=1. As the car moves upward, the detector 6 will disengage the cam 7, and the operation within the CPU 202 will be as follows: a signal routed from input 301 will exit through the "off" side of decision box 302, indicating that the detector 6 is not engaged. This signal will likewise exit through the "off" side of decision box 303, as the detector 5 has not as yet been engaged. This signal will be outputted at 316, but will not affect the RAM 204, as none of the boxes 310–313 has been activated.

When the cam 3 is engaged by the interfloor detector 5, the flow path through the CPU is altered to reflect this engagement, i.e., the signal will now flow out of the "on" side of decision box 303. Decision box 304 decides whether the value of "F" on RAM 204 is equal to "1". As RAM 204 is initially set such that "F"=1, a signal will exit from the "yes" side of the box 304, after which travel direction decision box 306 will route the signal out of the "up" side indicating that car 4 is travelling upward. When the signal passes through function boxes 310 and 314, the output signal will command RAM 204 to increment its floor count by one, such that it will now contain "FLOOR 2" in its memory. Simultaneously, the value of "F" in RAM 204 will be set to "0" due to the function of box 314.

When the car 4 reaches the second floor, the floor level detector 6 will engage the cam 8, causing the decision box 302 to now route the input signal to the "on" side. Since "F"=0 is true due to the previous function of box 314, the output from box 305 will be "yes". Travel direction decision box 307 will route the signal to the "up" side, as the car is travelling upward, and the signal will then enter decision box 308. The box 308 will route the signal to the "up" side if the car was travelling "up" the last time detector 5 was engaged, i.e. the last time direction detector 306 was operable to direct the signal to the "up" side. Since this is the case in the present situation, the signal is routed through the "up" side of decision box 308.

The signal is outputted at 316, via function box 315, the output causing RAM 204 to change its memorized value of "F" from "0" to "1".

This flow procedure is identical for further upward travel of the car 4 to further floors. In the case of normal downward travel, the procedure is similar, but the functions of direction decision boxes 306, 307 will be opposite and the RAM 204 will be made to decrement its stored FLOOR value since function box 311, rather than 310, is now operable.

As can easily be seen, if adnormal elevator operation occurs, the RAM 204 cannot be made to erroneously indicate an incorrect value of FLOOR. For example, if the elevator for some reason vibrates, causing detector 5 to successively engage the cam 3 more than once, RAM 204 will not be affected. This is because, upon the first engagement of detector 5 with cam 3, the value of "F" will be "1" thus causing a "yes" output from box 304. Upon subsequent engagement, however, "F" will be "0" due to the operation of box 314, and thus the output from 304 will be directed to the output 316, with no effect on RAM 204.

If, for some reason, the car 4 travels upwardly past the cam 3, and then returns to the first floor without reaching the second floor, the RAM 204 will increment its value of FLOOR upon engaging the cam 3 in its upward travel, and then will decrement the FLOOR value upon the car returning to the first floor. In this situation, the value of "F" is set to "0" upon the first engagement of cam 3 with the detector 5.

Subsequent engagements between cam 3 and detector 5 will have no effect either on the values of "F" or FLOOR which are now set at "0" and "2" respectively, memorized in RAM 204, as discussed above. Assuming the car 4 never reaches the second floor but instead returns to the first floor, the FLOOR value memorized in RAM 204 will be changed from "2" to "1" by the following operation. When the detector 6 is activated indicating a return to the first floor, box 305 will direct the signal to the "yes" side, and travel direction decision box 307 will direct the signal to the "down" side, indicating that the elevator is travelling down. Decision box 308 will direct its output to the "up" side because the last time direction decision box 306 was activated, the car was travelling upwardly. Function boxes 313 and 315 will now cause the signal outputted at 316 to change the memorized values of "F" and FLOOR in RAM 204 to "1" and "FLOOR 1" respectively, such that RAM 204 will correctly indicate the position of the elevator car in the hoistway.

As is apparent from the above description, the elevator position detector device according to the invention is controlled so that the car position signal memorized in the computer coincides precisely with the actual car position even if the interfloor detector operates erroneously or the elevator car moves irregularly.

While the present invention has been illustrated and described in conjunction with a single preferred embodiment thereof, it is to be understood that numerous changes and modifications may be resorted to without departing from the spirit and scope of the present invention.

What is claimed is:

1. An elevator position detector device, comprising:

an elevator car for travelling in either an upward or downward direction within a hoistway and selectively stopping at floor landings, interfloor position marking means disposed in said hoistway in an intermediate zone between adjacent floors, floor level position marking means disposed in said hoistway at a position to mark the level of a landing floor, at least one first detector for detecting said elevator car passing said interfloor position marking means, at least one second detector for detecting said elevator car when it is located at said floor level position marking means, and position detecting means for generating and storing a car position signal in response to output signals of said first and second detectors, and for modifying said car position signal only after said first and second detectors have detected said elevator car passing said interfloor position marking means and said elevator car at said floor level position marking means in the stated order.

2. An elevator position detector device as claimed in claim 1, wherein said position detecting means is further operable to detect whether the direction of travel of the elevator car when the second detector is operated is different from that at the time when the first detector was operated, and to modify the car position signal to that of the floor position at which said second detector is located when said difference is detected.

3. An elevator position detector device as claimed in claim 1, wherein said position detecting means comprises:

an input port receiving the signals from the first and second detectors, a read only memory (ROM), a random access memory (RAM) for memorizing a car position signal, a central processing unit (CPU) for performing a predetermined calculation in response to the read only memory (ROM), and a data bus for transmitting said signals.

* * * * *